United States Patent [19]

Liu

[11] Patent Number: 4,647,427

[45] Date of Patent: Mar. 3, 1987

[54] LONG RANGE ORDERED ALLOYS MODIFIED BY ADDITION OF NIOBIUM AND CERIUM

[75] Inventor: Chain T. Liu, Oak Ridge, Tenn.

[73] Assignee: The United States of America as represented by the United States Department of Energy, Washington, D.C.

[21] Appl. No.: 643,209

[22] Filed: Aug. 22, 1984

[51] Int. Cl.[4] ..... C22C 19/07; C22C 30/00

[52] U.S. Cl. ..... 420/435; 420/94; 420/95; 420/125; 420/126; 420/127; 420/581

[58] Field of Search ..... 420/435, 459, 581, 584, 420/585, 586; 148/11.5 N, 11.5 R, 12 R, 31, 425, 426, 442; 75/123 H, 123 J, 123 K

[56] References Cited

U.S. PATENT DOCUMENTS

| | | | |
|---|---|---|---|
| 4,144,059 | 3/1979 | Liu et al. | 420/435 |
| 4,238,229 | 12/1980 | Liu et al. | 148/11.5 R |
| 4,410,371 | 10/1983 | Liu et al. | 148/11.5 N |
| 4,421,558 | 12/1983 | Morichika et al. | 420/584 |
| 4,517,158 | 5/1985 | Miyauchi et al. | 420/584 |

*Primary Examiner*—L. Dewayne Rutledge
*Assistant Examiner*—Robert L. McDowell
*Attorney, Agent, or Firm*—Katherine Lovingodd; Stephen D. Hamel; Judson R. Hightower

[57] ABSTRACT

Long range ordered alloys are described having the nominal composition $(Fe,Ni,Co)_3(V,M)$ where M is a ductility enhancing metal selected from the group Ti, Zr, Hf with additions of small amounts of cerium and niobium to drammatically enhance the creep properties of the resulting alloys.

12 Claims, 2 Drawing Figures

LONG RANGE ORDERED ALLOYS MODIFIED BY ADDITION OF NIOBIUM AND CERIUM

This invention was made as a result of a contract with the U.S. Dept. of Energy.

BACKGROUND OF THE INVENTION

This invention relates to long range ordered alloys of the transition metals V, Fe, Ni, and Co, which have been improved by substituting small quantities of titanium and zirconium for like quantitites of V for improvement of mechanical properties and which have been further modified by addition of cerium and niobium to improve creep properties.

Ordered alloys are a unique class of metallic materials which form long range ordered crystal structures below their critical ordering temperature, $T_c$. Ordered alloys offer potential advantages over conventional disordered alloys for high temperature structural applications. Superior performance can be traced to the relatively low atomic mobility and unique dislocation dynamics in ordered lattices. The strength of ordered alloys does not degrade very rapidly with increasing temperature. In many cases, the yield strength of ordered alloys shows an increase rather than a decrease with increasing temperature. Long range order produces stronger bonding and closer packing between atoms. The restricted atomic mobility generally results in slower diffusion processes and better creep resistance in ordered lattices.

The advantage of LRO alloys is their strength and stability in use environments at high temperature. LRO alloys can experience high temperatures below $T_c$ for an indefinite period without undergoing significant compositional or phase changes. However, there are disadvantages at temperatures above $T_c$ and also at low temperatures substantially below $T_c$. Above $T_c$ the tensile strength is substantially reduced due to the disordering effect, and at lower temperatures the principal disadvantages have been their extreme brittleness and low ductility.

Developments have recently been made in the improvement of LRO alloys. Cobalt-based alloys with the nominal compositions $(Co,Fe)_3V$ and $(Co,Fe,Ni)_3V$ and high $T_c$ have been shown to significantly improve ductility, see U.S. Pat. No. 4,144,059, Liu et al, Mar. 13, 1979. However, these alloys are of limited use for nuclear applications due to the high neutron absorption cross section resulting from the cobalt content, and they are expensive due to the high cost of cobalt.

Consequently, improvements have been made by development of iron-based LRO alloys, minimizing the amount of needed cobalt, see U.S. Pat. No. 4,238,229, Liu et al, Dec. 9, 1980. It was surprising to find that an alloy containing zero or only a small amount of cobalt would demonstrate ordered structure in combination with excellent mechanical properties. These iron-based alloys showed highly desirable combinations of low neutron absorption cross section, high tensile strength, high yield strength, good tensile elongation, with no brittle phase formation at elevated temperatures. The disadvantage of the Fe-based alloys is their lower $T_c$ than Co-based alloys, thus the improved properties just described occur at lower temperatures than for the previously described Co-based alloys and their ductility decreases as $T_c$ is approached. The base alloys exhibit a tendancy toward grain boundary fracture and reduced ducility resulting from both grain boundary weakness and high flow stress near $T_c$. An LRO alloy with improved mechanical and metallurgical properties at elevated temperatures was yet to be developed.

Then it was found that additions of titanium and zirconium to these cobalt- and iron-based LRO alloys even further improved the ductility of the alloys at elevated temperatures, see U.S. Pat. No. 4,410,371 Liu et al, Oct. 18, 1983,. Creep tests indicated that these elements substantially increase the rupture ductility and extend the rupture life of the LRO alloys. Titanium additions also reduce the tendency toward intergrannular fatigue resistance of LRO alloys. However, excessive amounts of titanium (and probably other Group IV-A elements) significantly increase the creep rate and lower the creep resistance of LRO alloys. It was desired to further improve the creep properties of these alloys and that is an object of this invention.

SUMMARY OF THE INVENTION

Accordingly, it is a principal object of this invention to provide a high temperature, structural alloy having improved creep properties.

It is another object of this invention to provide a high temperature, structural alloy having reduced creep rates and increased rupture life.

These and other objects are achieved by addition of selected quantities of niobium and cerium to the previously modified and improved cobalt- and iron-based LRO alloys. A small amount of cerium ($\leqq$0.1 wt.%) together with titanium almost doubles the rupture ductility, substantially lowers the creep rate, and thus dramatically improves the rupture life of $(Fe,Ni)_3V$ alloys. Niobium in combination with titanium and/or cerium further improves the creep resistance of the LRO alloys.

DETAILED DESCRIPTION

Figure 1:
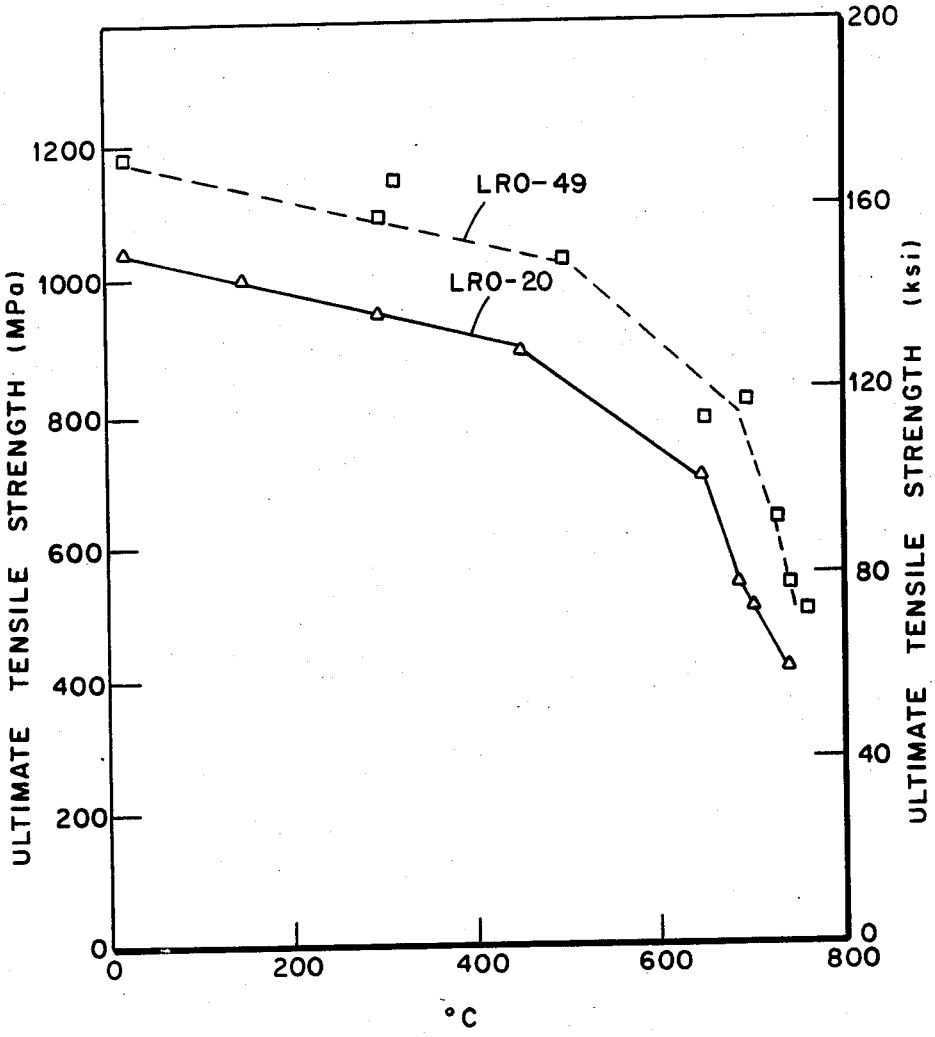
FIG. 1 is a graph showing the effect of temperature on ultimate tensile strength of base and Nb-modified LRO alloys based on LRO-20 $[(Fe_{50}Ni_{50})_3V]$.

The invention is an improved LRO alloy wherein the improvement is a composition which contains small amounts of cerium and niobium for enhancement of creep properties, specifically, markedly increased creep rupture ductility, lowered creep rate of iron-based alloys at temperatures near $T_c$, and improved creep resistance and rupture life of base LRO alloys.

Initially, each alloying element was added separately to base LRO alloys. Then beneficial elements were added together in order to study their synergistic effects. Table I lists the compositions of the base LRO alloys $(Fe_{50},Ni_{50})_3V$ and $(Fe_{22},Co_{78})_3V$ modified with cerium and niobium and also titanium, zirconium and aluminum and the designations used to identify the alloys reported herein.

In accordance with the present invention it was discovered that the addition of small amounts of niobium and cerium to long range ordered cobalt- and iron-based alloy compositions of the type $(Fe,Ni,Co)_3(V,M)$ increased the alloy rupture life and decrease the alloy creep rate. The iron-based alloy has a composition in the range of 22–23 wt.% V, 35–50 wt.% Fe, 0–22 wt.%

Co, 19–40 wt.% Ni, and 0.4–1.4 wt.% of metal M selected from the group Ti, Zr, Hf and mixtures thereof and cobalt-based alloy has a composition in the range of 22–23 wt.% V, 14–30 wt.% Fe, 37–64 wt.% Co, 0–10 wt.% Ni, and 0.4–1.4 wt.% of metal M selected from the group consisting of Ti, Zr, Hf and mixtures thereof.

The invention is demonstrated by further modifying the Ti-modified alloys of LRO-37 and LRO-23. Additions of Ce and Nb and mixtures thereof were found to improve the creep ductility, creep rate, and creep rupture time of the LRO-37 and LRO-23 type alloys. The beneficial effect of cerium is not well understood but may result from scavenging sulfur (a trace impurity in alloys) at grain boundaries through a precipitation reaction. Other rare earth elements may exhibit similar scavenging abilities, however they are not as thermodynamically reactive as cerium. Niobium additions may contribute to the solid solution hardening of the LRO alloys by exhibiting atom diffusion.

EXAMPLE

LRO alloys with the cubic ordered crystal structure ($L1_2$-type) were prepared by arc or electron-beam melting and drop casting into a mold to form ingots. To minimize the impurity content in the alloys, electron-beam melted Fe, Co, and Ni and high-purity V (total impurity <700 ppm) were used as charge materials. Modified LRO alloys were prepared using pure alloying elements and an Fe-4 wt.% Ce master alloy. Alloy additions were added for the purpose of partial replacement of vanadium, that is, the modified alloys have the alloy formula $(Fe,Co,Ni)_3(V,X)$. Table 1 lists the compositions of several Fe-based and Co-based alloys within the scope of the present invention.

TABLE 1

Designations and compositions of modified LRO alloys based on LRO-20 and −1

| Alloy | Alloy Formula | Alloy Compositions, wt. % |
|---|---|---|
| LRO-20 | $(Fe_{50}Ni_{50})_3V$ | Fe—39.5Ni—22.9V |
| LRO-37 | $(Fe_{50}Ni_{50})_3(V_{98}Ti_2)$ | Fe—39.5Ni—22.4V—0.4Ti |
| LRO-38 | $(Fe_{50}Ni_{50})_3(V_{96}Ti_4)$ | Fe—39.5Ni—22.0V—0.9Ti |
| LRO-60 | $(Fe_{50}Ni_{50})_3(V_{98}Ti_2)$ + 0.04 wt. % Ce | Fe—39.5Ni—22.4V—0.4Ti—0.04Ce |
| LRO-42 | $(Fe_{50}Ni_{50})_3(V_{98}Ti_2)$ + 0.1 wt. % Ce | Fe—39.5Ni—22.4V—0.4Ti—0.1Ce |
| LRO-43 | $(Fe_{50}Ni_{50})_3(V_{98}Ti_2)$ + 0.3 wt. % Ce | Fe—39.4Ni—22.4V—0.4Ti—0.3Ce |
| LRO-49 | $(Fe_{50}Ni_{50})_3(V_{93}Ti_4Nb_3)$ | Fe—39.4Ni—21.2V—0.9Ti—1.2Nb |
| LRO-85 | $(Fe_{50}Ni_{50})_3(V_{93}Ti_4Nb_3)$ + 0.04 wt. % Ce | Fe—39.4Ni—21.2V—0.9Ti—1.2Nb—0.04Ce |
| LRO-1 | $(Fe_{22}Co_{78})_3V$ | Co—16.3Fe—22.6V |
| LRO-34 | $(Fe_{22}Co_{78})_3(V_{98.2}Ti_{1.8})$ | Co—16.3Fe—22.2V—0.4Ti |
| LRO-23 | $(Fe_{22}Co_{78})_3(V_{96}Ti_4)$ | Co—16.4Fe—21.7V—0.8Ti |
| LRO-33 | $(Fe_{22}Co_{78})_3(V_{96}Zr_4)$ | Co—16.2Fe—21.5V—1.6Zr |
| LRO-24 | $(Fe_{22}Co_{78})_3(V_{96}Al_4)$ | Co—16.4Fe—21.8V—0.5Al |
| LRO-26 | $(Fe_{22}Co_{78})_3(V_{94}Ti_2Al_4)$ | Co—16.4Fe—21.4V—0.4Ti—0.5Al |
| LRO-25 | $(Fe_{22}Co_{78})_3(V_{92}Ti_4Al_4)$ | Co—16.4Fe—20.9V—0.9Ti—0.5Al |
| LRO-32 | $(Fe_{22}Co_{78})_3(V_{92}Nb_8)$ | Co—16.1Fe—20.5V—3.2Nb |
| LRO-61 | $(Fe_{22}Co_{78})_3(V_{93}Ti_4Nb_3)$ + 0.04 wt. % Ce | Co—16.3Fe—20.9V—0.8Ti—1.2Nb—0.4Ce |

The ingots were initially fabricated into sheets by hot rolling between molybdenum cover sheets at 1100° C., followed by cold rolling at room temperature. The molybdenum cover sheets were used for insulation from the cold rolls and to prevent excessive oxidation and contamination from lubricants. After hot breakdown, the alloy plates were cold rolled with a reduction of 30 to 60% in thickness. All the alloys listed in Table 1 were successfully fabricated into sheets of good quality, except those alloyed with excessive amounts of Ce and Nb which had an adverse effect on fabrication of the LRO alloys. For instance, $(Fe_{50}Ni_{50})$ alloy doped with 0.3 wt.% Ce (i.e., LRO-43) cracked badly during hot rolling at 1100° C. The alloy $(Fe_{22}Co_{78})_3V$ exhibited some surface and edge cracks during hot rolling, when alloyed with 3.2 wt.% Nb (i.e., LRO-32). Thus, from the fabrication viewpoint, the optimum amount of Ce and Nb should be less than 0.3 and 3.2 wt.%, respectively.

The base LRO alloys exhibited a creep rupture ductility of less than 10% at temperatures below $T_c$. Microscopic examination of fracture surfaces revealed that the low rupture ductility is generally associated with nucleation, growth, and coalescence of cavities along grain boundaries. Tables 2 and 3 list limited creep data that show the effect of alloy additions on creep properties of the base LRO alloys, LRO-20 and LRO-1, respectively. A small amount of cerium (≦0.1 wt.%) together with titanium almost doubles the rupture ductility, substantially lowers the creep rate, and thus dramatically improves the rupture life of $(Fe,Ni)_3V$ alloys as shown by LRO-42. Niobium in combination with titanium and/or cerium further improves the creep resistance of the LRO alloys as shown by LRO-61 and LRO-49. As indicated in Table 2, the creep rupture life of Ce-modified LRO-42 and Nb-modified LRO-49 is longer than that of the base alloy LRO-20 by about three orders of magnitude when creep tested at 551 MPa (80 ksi) and 650= C. The Nb-modified LRO-49 exhibited a creep rate lower than that of type 316 stainless steel by more than four orders of magnitude at 670° C.

TABLE 2

Comparison of creep properties of base and modified LRO alloys based on LRO-20 $(Fe_{50}Ni_{50})_3V$

| Alloy Number | Alloy formula | Steady State Creep Rate ($h^{-1}$) | Test Time or[a] rupture time (h) | Measured ductility[b] or ruptured ductility (%) |
|---|---|---|---|---|
| | | 551 MPa[d] and 650° C. | | |
| LRO-20 | $(Fe_{50}Ni_{50})_3V$ | $1.3 \times 10^{-2}$ | 0.9 | 4.8% |
| LRO-42 | $(Fe_{50}Ni_{50})_3(V_{98}Ti_2)$ + 0.1 wt. % Ce | $6.2 \times 10^{-5}$ | 451 | 8.0 |
| LRO-49 | $(Fe_{50}Ni_{50})_3(V_{93}Ti_4Nb_3)$ | $5.8 \times 10^{-5}$ | >500[a] | >8.5[b] |

TABLE 2-continued

| Alloy Number | Alloy formula | Steady State Creep Rate ($h^{-1}$) | Test Time or[a] rupture time (h) | Measured ductility[b] or ruptured ductility (%) |
|---|---|---|---|---|
| Comparison of creep properties of base and modified LRO alloys based on LRO-20 $(Fe_{50}Ni_{50})_3V$ | | | | |
| | | 413 MPa[c] and 670° C. | | |
| LRO-37 | $(Fe_{50}Ni_{50})_3(V_{98}Ti_2)$ | $5.2 \times 10^{-5}$ | 250 | 1.8 |
| LRO-49 | $(Fe_{50}Ni_{50})_3(V_{93}Ti_4Nb_3)$ | $2.2 \times 10^{-5}$ | >1102[a] | >4.2[b] |
| | | 551 MPa[d] and 670° C. | | |
| LRO-42 | $(Fe_{50}Ni_{50})_3(V_{98}Ti_2)$ + 0.1 wt. % Ce | $9.9 \times 10^{-5}$ | 537 | 9.8 |

[a]The test was stopped (without rupture) at the time indicated.
[b]Measured ductility is the ductility of the specimen at the time when the test was stopped (without rupture).
[c]60 ksi
[d]80 ksi

TABLE 3

| Alloy Number | Alloy formula | Steady State Creep Rate ($h^{-1}$) | Test Time or[a] rupture time (h) | Measured ductility[b] or ruptured ductility (%) |
|---|---|---|---|---|
| Comparison of creep properties of base and modified LRO alloys based on LRO-1 $(Fe_{22}Co_{78})_3V$ | | | | |
| | | 276 MPa[c] and 760° C. | | |
| LRO-1 | $(Fe_{22}Co_{78})_3V$ | $1.9 \times 10^{-4}$ | 300 | 8 |
| LRO-23 | $(Fe_{22}Co_{78})_3(V_{96}Ti_4)$ | $1.0 \times 10^{-4}$ | >800[a] | >9.2[b] |
| LRO-33 | $(Fe_{22}Co_{78})_3(V_{96}Zr_4)$ | $3.5 \times 10^{-4}$ | >400[a] | >1.4[b] |
| LRO-61 | $(Fe_{22}Co_{78})_3(V_{93}Ti_4Nb_3)$ + 0.04 wt. % Ce | $6.5 \times 10^{-5}$ | >330 | — |
| | | 413 MPa[d] and 760° C. | | |
| LRO-1 | $(Fe_{22}Co_{78})_3V$ | $2.9 \times 10^{-3}$ | 2.3 | 4 |
| LRO-61 | $(Fe_{22}Co_{78})_3(V_{93}Ti_4Nb_3)$ + 0.04 wt. % Ce | $7.5 \times 10^{-4}$ | 90 | 13 |

Figure 2:
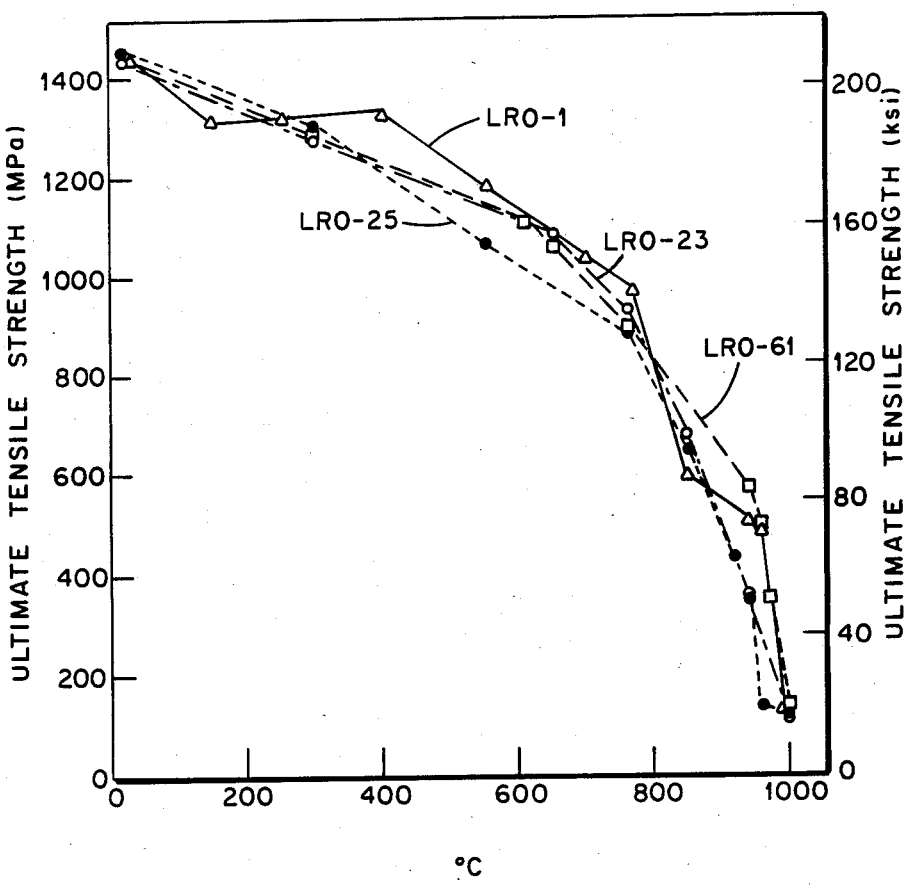
FIG. 2 is a graph showing the effect of temperature on ultimate tensile strength of base and modified LRO alloys based on LRO-1 $[(Fe_{22}Co_{78})_3V]$.

[a]The test was stopped (without ruture) at the time indicated.
[b]Measured ductility is the ductility of the specimen at the time when the test was stopped (without rupture).
[c]40 ksi
[d]60 ksi The tensile properties of base and modified LRO alloys were determined at temperature to 1000° C. FIGS. 1 and 2 show their ultimate tensile strength as a function of temperature. Additions of niobium in combination with titanium and/or cerium cause a moderate increase in the strength of the Fe-base LRO-20 but appear not to affect the strength much in the Co-base LRO-1.

The preferred quantitites of cerium are in the range 0.03 to 0.10 wt.% while niobium additions in the range 1.0 to 2.5 wt.% are preferred.

Thus, it is seen that the modified alloys of this invention provide improved properties in base LRO alloys which enhance their applicability as hot components in conventional closed-cycle energy conversion systems such as advanced heat engines, Stirling engines and other high temperature systems; advanced steam power plants, steam generators and turbines; nuclear process heat systems, ducting and heat exchangers; and closed-cycle solar power systems. The modified LRO alloys possess excellent high temperature strength, creep properties and fatigue resistance. The above properties, in combination with superior corrosion resistance in steam environments, make these alloys particularly suitable for steam turbine applications. Many variations in the present invention will be apparent to those skilled in the art for which it is intended. However, such variations are embodied within the scope of the following claims.

I claim:

1. A long range ordered alloy composition consisting essentially of iron, nickel, cobalt, vanadium and a ductility enhancing metal, having the nominal composition $(Fe,Ni,Co)_3(V,M)$ where M is said ductility enhancing metal selected from the group Ti, Zr, Hf and mixtures thereof, with effective amounts of creep property enhancing elements selected from the group cerium, niobium and mixtures thereof sufficient to enhance creep properties in the resulting alloy without adversely affecting the fabrication of the alloy.

2. The long range ordered alloy of claim 1 wherein said creep property enhancing element is 0.03–0.1 wt.% cerium.

3. The long range ordered alloy of claim 1 wherein said creep property enhancing element is 1.0–2.5 wt.% niobium.

4. The long range ordered alloy of claim 1 wherein said creep property enhancing element is 0.03–0.1 wt.% cerium and 1.0–2.5 wt.% niobium.

5. A long range ordered alloy composition, said alloy having the nominal composition $(Fe,Ni,Co)_3(V,M)$ consisting of a composition in the range of 22–23 wt.% V, 35–50 wt.% Fe, 0–22 wt.% Co, 19–40 wt.% Ni, 0.4–1.4 wt.% of metal M selected from the group consisting of Ti, Zr, Hf and mixtures thereof, and effective amounts of creep property enhancing elements selected from the group cerium, niobium and mixtures thereof, sufficient to enhance creep properties in the resulting alloy without adversely effecting the fabrication of the alloy.

6. The long range ordered alloy of claim 5 wherein said creep property enhancing element is 0.03–0.1 wt.% cerium.

7. The long range ordered alloy of claim 5 wherein said creep property enhancing element is 1.0–2.5 wt.% niobium.

8. The long range ordered alloy of claim 5 wherein said creep property enhancing element is 0.03–0.1 wt.% cerium and 1.0–2.5 wt.% niobium.

9. A long range ordered alloy composition, said alloy having the nominal composition $(Fe,Ni,Co)_3(V,M)$ consisting of a composition in the range of 22–23 wt.% V, 14–30 wt.% Fe, 37–64 wt.% Co, 0–10 wt.% Ni, and 0.4–1.4 wt.% of metal selected from the group consisting of Ti, Zr, Hf and mixtures thereof, and effective amounts of creep property enhancing elements selected from the group cerium, niobium and mixtures thereof, sufficient to enhance creep properties in the resulting alloy without adversely effecting the fabrication of the alloy.

10. The long range ordered alloy of claim 9 wherein said creep property enhancing element is 0.03–0.1 wt.% cerium.

11. The long range ordered alloy of claim 9 wherein said creep property enhancing element is 1.0–2.5 wt.% niobium.

12. The long range ordered alloy of claim 9 wherein said creep property enhancing element is 0.03–0.1 wt.% cerium and 1.0–2.5 wt.% niobium.

* * * * *